US006099103A

United States Patent [19]

Takahashi

[11] Patent Number: 6,099,103

[45] Date of Patent: Aug. 8, 2000

[54] INK DROPLET EJECTING METHOD AND APPARATUS

[75] Inventor: Yoshikazu Takahashi, Nagoya, Japan

[73] Assignee: Brother Kogyo Kabushiki Kaisha, Nagoya, Japan

[21] Appl. No.: 09/200,987

[22] Filed: Nov. 30, 1998

[30] Foreign Application Priority Data

Dec. 10, 1997 [JP] Japan ..... 9-340352
Apr. 3, 1998 [JP] Japan ..... 10-091662

[51] Int. Cl.[7] ..... B41J 29/38
[52] U.S. Cl. ..... 347/11
[58] Field of Search ..... 347/9–14, 8

[56] References Cited

U.S. PATENT DOCUMENTS

| | | | |
|---|---|---|---|
| 4,523,200 | 6/1985 | Howkins | 347/11 |
| 5,028,936 | 7/1991 | Bartky et al. | 347/69 |
| 5,736,994 | 4/1998 | Takahashi | 347/111 |
| 5,736,995 | 4/1998 | Bohorquez et al. | 347/14 |
| 5,903,286 | 5/1999 | Takahashi | 347/11 |

FOREIGN PATENT DOCUMENTS 63-247051 10/1988 Japan .

*Primary Examiner*—John Barlow
*Assistant Examiner*—Craig A. Hallacher
*Attorney, Agent, or Firm*—Oliff & Berridge, PLC

[57] ABSTRACT

In an ink droplet ejecting method and apparatus, a main driving waveform for the ejection of ink droplet is followed by two additional non-jet pulses, for one dot, without changing a driving voltage, whereby not only an ink droplet of a small volume can be obtained, but also the ink droplet speed in the second ejection after a stop which follows continuous droplet ejection is prevented from becoming lower. The application of a jet pulse signal A of one dot is followed by the application of both a droplet downsizing pulse B as a non-jet pulse for reducing the size of an ejected ink droplet, the pulse B being smaller in pulse width than the jet pulse signal A, and a jet stabilizing pulse C as a non-jet pulse for stabilizing the ejection of ink droplet. By so doing, even when the ink viscosity is low at a high temperature, the ejection of ink droplet is stabilized and a decrease in the droplet speed is prevented.

23 Claims, 9 Drawing Sheets

INK DROPLET EJECTING METHOD AND APPARATUS

BACKGROUND OF THE INVENTION

1. Field of the Invention

The invention relates to an ink droplet ejecting method and apparatus of an ink jet type.

2. Description of Related Art

According to a known ink jet printer of an ink jet type, the volume of an ink flow path is changed by deformation of a piezoelectric ceramic material, and when the flow path volume decreases, the ink present in the ink flow path is ejected as a droplet from a nozzle, while when the flow path volume increases, the ink is introduced into the ink flow path from an ink inlet. In this type of a printing head, a plurality of ink chambers are formed by partition walls of a piezoelectric ceramic material, and ink supply means, such as ink cartridges, are connected to one end of the plural ink chambers, while at the opposite end of each of the ink chambers an ink ejecting nozzle is provided (hereinafter referred to simply as "nozzles"). The partition walls are deformed in accordance with printing data to make the ink chambers smaller in volume, whereby ink droplets are ejected onto a printing medium from the nozzles to print, for example, a character or a figure.

As this type of an ink jet printer, a drop-on-demand type ink jet printer which ejects ink droplets is popular because of high ejection efficiency and low running cost. As an example of the drop-on-demand type there is known a shear mode type using a piezoelectric material, as is disclosed in Japanese Published Unexamined Patent Application No. Sho 63-247051.

As shown in FIGS. 8A and 8B, this type of an ink droplet ejecting apparatus 600 comprises a bottom wall 601, a top wall 602 and shear mode actuator walls 603 located therebetween. The actuator walls 603 each comprise a lower wall 607 bonded to the bottom wall 601 and polarized in the direction of arrow 611 and an upper wall 605 formed of a piezoelectric material, the upper wall 605 being bonded to the top wall 602 and polarized in the direction of arrow 609. Adjacent actuator walls 603, as a pair, define an ink chamber 613 therebetween, and next adjacent actuator walls 603, as a pair, define a space 615 which is narrower than the ink chamber 613.

A nozzle plate 617 having nozzles 618 is fixed to one end of the ink chambers 613, while to the opposite end of the ink chambers is connected the ink supply source (not shown). On both side faces of each actuator wall 603 are formed electrodes 619, 621, respectively, as metallized layers. More specifically, the electrode 619 is formed on the actuator wall 603 on the side of the ink chamber 613, while the electrode 621 is formed on the actuator wall 603 on the side of the space 615. The surface of the electrode 619 is covered with an insulating layer 630 for insulation from ink. The electrode 621 which faces the space 615 is connected to a ground 623, and the electrode 619 provided in each ink chamber 613 is connected to a controller 625 which provides an actuator drive signal to the electrode.

The controller 625 applies a voltage to the electrode 619 in each ink chamber, whereby the associated actuator walls 603 undergo a piezoelectric thickness slip deformation in directions to increase the volume of the ink chamber 613. For example, as shown in FIG. 9, when voltage E(V) is applied to an electrode 619 *c* in an ink chamber 613*c*, electric fields are generated in directions of arrows 629, 631, 630 and 632, respectively, in actuator walls 603*e*, 603*f*, so that the actuator walls 603*e*, 603*f* undergo a piezoelectric thickness slip deformation in directions to increase the volume of the ink chamber 613 *c*. At this time, the internal pressure of the ink chamber 613 *c*, including a nozzle 618*c* and the vicinity thereof, decreases. The applied state of the voltage E(V) is maintained for only a one-way propagation time T of a pressure wave in the ink chamber 613. During this period, ink is supplied from the ink supply source.

The one-way propagation time T is a time required for the pressure wave in the ink chamber 613 to propagate longitudinally through the same chamber. Given that the length of the ink chamber 613 is L and the velocity of sound in the ink present in the ink chamber 613 is a, the time T is determined to be T=L/a.

According to the theory of pressure wave propagation, upon lapse of time T or an odd-multiple time thereof after the above application of voltage, the internal pressure of the ink chamber 613 reverses into a positive pressure. In conformity with this timing, the voltage being applied to the electrode 621*c* in the ink chamber 613*c* is returned to 0 (V). As a result, the actuator walls 603*e* and 603*f* revert to their original state (FIG. 8A) before the deformation, whereby a pressure is applied to the ink. At this time, the above positive pressure and the pressure developed by the reversion of the actuator walls 603*e* and 603*f* to their original state before the deformation are added together to afford a relatively high pressure in the vicinity of the nozzle 618*c* in the ink chamber 613 *c*, whereby an ink droplet is ejected from the nozzle 618 *c*. An ink supply passage 626 communicating with the ink chamber 613 is formed by members 627, 628.

In the ink droplet ejecting apparatus 600, if control lowers the driving voltage for allowing a small volume of an ink droplet to be ejected with a view to enhancing the printing resolution, there arises the problem that the speed of the ink droplet also decreases. In order that an ink droplet of a small volume may be obtained without a decrease in the ink ejection speed, there has been proposed the addition of pulses low in voltage level after application of a jet pulse and before the completion of ink ejection as disclosed in U.S. Pat. No. 4,523,200 to Howkins. In this case, a plurality of voltages are required as driving pulses and a complicated control is needed among a series of pulses, thus leading to an increase in the cost of a driver IC and of the printer.

For obtaining an ink droplet of a small volume, applicant has studied a driving method in which a non-jet pulse is applied after application of a jet pulse to an actuator. However, it turned out that if at a high temperature, continuous dot printing is performed, then the dot printing is stopped by one dot, i.e., a dot is skipped, and is thereafter started again, the ink droplet speed of the second dot after the restart decreases. This is presumed to be because the oscillating state of the ink meniscus becomes unstable due to a lowering in viscosity of the ink at the high temperature and an additional pulse is applied when the ink meniscus is retracted from the associated nozzle, thus causing a decrease of the ink droplet speed. As a result, there arises the problem that the ejected ink droplet follows a curved path and does not arrive at a correct position, causing the print quality to deteriorate.

SUMMARY OF THE INVENTION

The invention has been accomplished for solving the above-mentioned problems. It is an object of the invention to provide an ink ejecting method and apparatus wherein after a driving waveform for a primary ink jet for one dot, two non-jet pulses are added without changing a driving voltage, thereby providing an ink droplet of a small volume, wherein the ink droplet speed in the second ink jet after a stop which follows a continuous ink jet does not become lower. Thus, it is possible to prevent the ink droplet from arriving at a deviated position which leads to a deterioration in the print quality.

In order to achieve the above-mentioned object, the invention resides in an ink droplet ejecting method wherein a jet pulse signal is applied to an actuator for changing the volume of an ink chamber filled with ink, to generate a pressure wave within the ink chamber, thereby applying pressure to the ink and allowing a droplet of the ink to be ejected from a nozzle, wherein the jet pulse signal is applied in accordance with a one-dot printing instruction and, as non-jet pulse signals which follow the application of the jet pulse signal, there are applied a first additional pulse signal for downsizing the ink droplet which is ejected in accordance with the jet pulse signal and a second additional pulse signal for stabilizing the ejection of the ink droplet.

In the above method, the ink present in the ink chamber is about to rush out from the nozzle in accordance with the jet pulse signal which is applied as a one-dot printing instruction, and a part of an ink droplet which is rushing out from the nozzle is pulled back in accordance with the first additional pulse signal as a non-jet pulse signal is applied following the jet pulse signal, whereby the ejected ink droplet which is being ejected becomes smaller and hence it is possible to enhance the printing resolution. Even if the viscosity of the ink becomes lower at a high temperature and the meniscus thereof becomes unstable, since the second additional signal is subsequent to the first additional signal, there is obtained an action of stabilizing the next ink ejection and hence the decrease in the ink droplet speed is prevented. Moreover, because it is not necessary to change the driving voltage for downsizing the ink droplet, a cost increase does not result. Particularly, in the case where the temperature is high and only the first additional pulse signal is applied, without application of the second additional pulse signal, and when a one-dot stop follows continuous dots and then there are dots thereafter, the ink droplet speed tends to decrease at the second dot in the latter dot ejection. But this problem is solved because the second additional pulse signal is applied.

The invention resides in an ink droplet ejecting method, wherein the jet pulse signal has a pulse width which allows the volume of the ink chamber to increase upon application of a voltage to the actuator, thereby causing a pressure wave to be generated within the ink chamber, and which, after the lapse of time T required for an approximately one-way propagation of the pressure wave through the ink chamber or after the lapse of an odd-multiple time of the time T, allows the volume of the ink chamber to decrease from the increased state to a normal state, the first and second pulse signals have a pulse width of approximately 0.2T to 0.4T relative to the jet pulse signal, a time difference between a fall timing of the jet pulse signal and a rise timing of the first additional pulse signal is 0.4T to 0.7T, and a time difference between a fall timing of the first additional pulse signal and a rise timing of the second additional pulse signal is 0.9T to 1.3T.

According to this method, even in the case where the viscosity of the ink is low at a high temperature and continuous dots are followed by a one-dot stop and again there are dots thereafter, it is possible to surely prevent a decrease of the ink droplet speed in the latter ink ejection.

The invention resides in an ink droplet ejecting method, wherein a peak value of the jet pulse signal and peak values of the first and second additional pulse signals are all the same. Consequently, the use of a single power source suffices, without the need of changing the driving voltage.

The invention resides in an ink droplet ejecting method, wherein the jet pulse signal comprises two jet pulse signals. Consequently, it becomes easier to change the size of an ink droplet as desired and thereby enhance the gradation.

The invention resides in an ink droplet ejecting method, wherein the jet pulse signal is divided into a primary jet pulse signal and a secondary jet pulse signal, and the first additional signal is applied between the primary jet pulse signal and the secondary jet pulse signal. According to this method there is obtained the same effect as a fourth aspect of the invention.

The invention resides in an ink droplet ejecting method, wherein the jet pulse signal has a pulse width which allows the volume of the ink chamber to increase upon application of a voltage to the actuator, thereby causing a pressure wave to be generated within the ink chamber, and which, after the lapse of time T required for an approximately one-way propagation of the pressure wave through the ink chamber or after the lapse of approximately 0.5T to 1.5T, the first additional pulse signal has a pulse width of approximately 0.3T to 1.0T and a time difference between a fall timing of the jet pulse signal and a rise timing of the first additional pulse signal has a time difference of 0.3T to 1.0T, a sum of a time difference between a fall timing of the jet pulse signal and a rise timing of the first additional pulse signal and a pulse width of the first additional pulse signal is approximately 0.7T to 1.3T, the second additional pulse signal has a pulse width of approximately 0.2T to 0.4T, and a time difference between a fall timing of the first additional pulse signal and a rise timing of the second additional pulse signal is approximately 0.7T to 1.3T.

According to this method, the first and second additional pulse signals following the jet pulse signal can be outputted without delaying from the pulse width of the jet pulse signal relatively. As a result, it is possible to avoid occurring any spray or incomplete ejection when ink is ejected thereafter, disturbance of the ink droplet does not occur and a good printing result can be obtained.

The invention resides in an ink droplet ejecting apparatus including an ink chamber filled with ink, an actuator for changing the volume of the ink chamber, a driving power source for applying an electric signal to the actuator, and a controller which provides control so that a jet pulse signal is applied to the actuator from the driving power source to increase the volume of the ink chamber and thereby generate a pressure wave in the ink chamber and so that, when the time required for an approximately one-way propagation of the pressure wave through the ink chamber is assumed to be T, the volume of the ink chamber is decreased to a normal state from the increased state after the lapse of the time T or after the lapse of an odd-multiple time of the time T, thereby applying pressure to the ink present in the ink chamber and allowing an ink droplet to be ejected, wherein the controller, in accordance with a one-dot printing instruction, causes the ink jet pulse signal to be applied to the actuator from the driving power source and causes a first additional pulse signal for downsizing the ink droplet which is ejected in accordance with the jet pulse signal and a second additional pulse signal for stabilizing the ejection of the ink, as non-jet pulse signals which follow the application of the jet pulse signal, to be applied from the driving power source. According to this structure there is obtained the same effect as the first aspect of the invention.

The invention resides in an ink droplet ejecting apparatus, wherein peak values of the first and second additional pulse signals are the same as a peak value of the jet pulse signal, and the first additional pulse signal is smaller in pulse width than the jet pulse signal and is outputted so as to pull back a part of the ink droplet which is being ejected in accordance with the jet pulse signal. According to this apparatus, by changing the pulse width of a pulse signal applied from a single driving power source, it is possible to easily realize the reduction in size of the ejected ink droplet.

The invention resides in an ink droplet ejecting apparatus, wherein the controller provides control so that the jet pulse signal has a pulse width which allows the volume of the ink chamber to increase upon application of a voltage to the actuator, thereby causing a pressure wave to be generated within the ink chamber, and which, after the lapse of time T required for an approximately one-way propagation of the pressure wave through the ink chamber or after the lapse of an odd-multiple time of the time T, allows the volume of the ink chamber to decrease from the increased state to the normal state, and so that the first and second additional pulse signals have a pulse width of approximately 0.2T to 0.4T relative to the jet pulse signal, a time difference between a fall timing of the jet pulse signal and a rise timing of the first additional pulse signal is 0.4T to 0.7T, and a time difference between a fall timing of the first additional pulse signal and a rise timing of the second additional pulse signal is 0.9T to 1.3T. This structure affords the same effect as the second aspect of the invention.

The invention resides in an ink droplet ejecting apparatus, wherein the controller has a temperature detecting means and provides control so that the first and second additional pulse signals are applied in accordance with the temperature detected by the temperature detecting means. According to this apparatus, even if the oscillation of the ink meniscus becomes unstable in a temperature region in which the ink viscosity drops, the decrease of the ink droplet speed is prevented by virtue of the first and second additional pulse signals, while in a temperature region of a relatively high ink viscosity, it is possible to diminish the load on the controller.

The invention resides in an ink droplet ejecting apparatus, wherein the ink ejecting pulse signal has a pulse width of approximately 0.5T to 1.5T, the first additional pulse signal has a pulse width of approximately 0.3T to 1.0T and a time difference between a fall timing of the jet pulse signal and a rise timing of the first additional pulse signal has a time difference of 0.3T to 1.0T, a sum of a time difference between a fall timing of the jet pulse signal and a rise timing of the first additional pulse signal and a pulse width of the first additional pulse signal is approximately 0.7T to 1.3T, the second additional pulse signal has a pulse width of approximately 0.2T to 0.4T, and a time difference between a fall timing of the first additional pulse signal and a rise timing of the second additional pulse signal is approximately 0.7T to 1.3T. This structure affords the same effect as the sixth aspect of the invention.

According to the invention, as set forth above, because there is applied, as a one-dot printing instruction, the second additional pulse signal following the jet pulse signal and the first additional pulse signal as a non-jet pulse signal, the droplet of ink which is flying after ejection becomes smaller and hence it is possible to enhance the printing resolution. Moreover, even when the viscosity of ink is low at a high temperature, with the occurrence of meniscus oscillation, and the ejection of ink is unstable, there is obtained a function of stabilizing the ejection of ink and a decrease in the ink droplet speed is prevented. Particularly, with only the first additional pulse applied at a high temperature and when continuous dots are followed by a one-dot rest and again subsequent dots, the ink droplet speed tends to decrease at the second dot of the latter dots. However, the decrease is prevented by the application of the second additional pulse signal. Further, as the values of the first and second additional pulse signals are made equal to each other to eliminate the need to change the driving voltage, the provision of a single driving power source suffices and a reduction in costs results.

Further, the pulse width of the jet pulse is within the range of 0.5T to 1.5T, and, thus, the time difference between the fall timing of the jet pulse signal and the rise timing of the first additional pulse signal, the sum of the time difference and the pulse width of the first additional pulse signal, the pulse width of the second additional pulse signal, and the time difference between the fall timing of the first additional pulse signal and the rise timing of the second additional pulse signal are adjusted properly. Therefore, as the first and second additional pulse signal are outputted without delay from the pulse width of the jet pulse signal, spraying or incomplete ejection does not occur and good print results are obtained.

BRIEF DESCRIPTION OF THE DRAWINGS

A preferred embodiment of the invention will be described in detail with reference to the following figures wherein.

DETAILED DESCRIPTION OF THE PREFERRED EMBODIMENT

An embodiment of the invention will be described hereinunder with reference to the drawings. The structure of a mechanical portion of the ink droplet ejecting apparatus of the embodiment is the same as that shown in FIGS. 8A, 8B and 9 and therefore an explanation thereof is not repeated here.

An example of the dimensions of the ink droplet ejecting apparatus, indicated at 600, are: the length L of an ink chamber 613 is 7.5 mm; and the dimensions of a nozzle 618; its diameter on an ink droplet ejection side is 40 $\mu$m, its diameter on the ink chamber 613 side is 72 μm, and its length is 100 μm. The viscosity, at 25° C., of ink used in an experiment is about 2 mPas and the surface tension thereof is 30 mN/m. The ratio of the length L to a sonic velocity, a, in the ink present within the ink chamber 613, i.e., L/a (=T), was 8 μsec.

Figure 1:
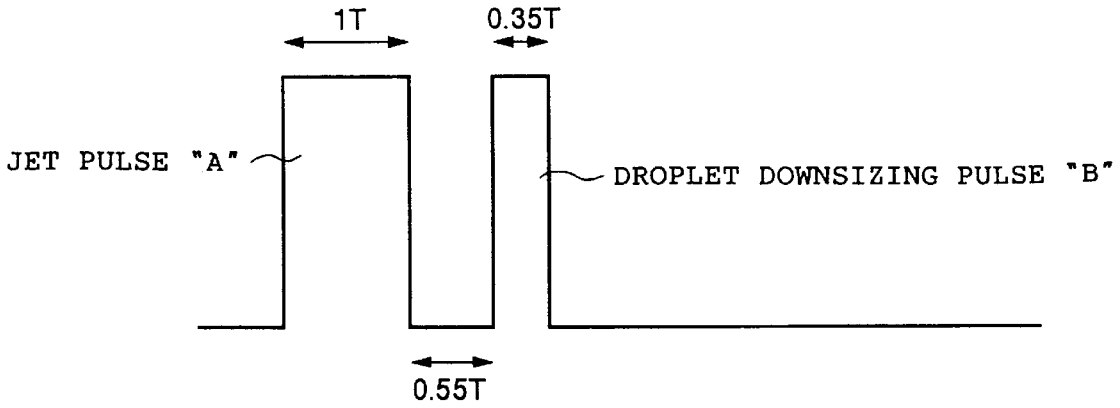
FIG. 1 is a diagram showing a jet pulse signal (driving waveform) for reducing the size of ink droplet as a precondition in the invention.

A description will now be given of various driving waveforms to be applied to an electrode 619 disposed in the ink chamber 613 in the embodiment of the invention. FIG. 1 shows a jet pulse signal (driving waveform) for downsizing an ink droplet as a precondition in the invention. The driving waveform shown in FIG. 1 is of pulses for printing one dot, which comprise a jet pulse signal A for the ejection of ink droplet and an additional pulse signal (a droplet downsizing pulse) B smaller in pulse width than the jet pulse signal A and functioning to reduce the size of a flying ink droplet. The additional pulse signal B is a non-jet pulse signal applied additionally and subsequent to the jet pulse signal A at a timing capable of pulling back a part of an ink droplet which has rushed out from the nozzle in accordance with the jet pulse signal A. Both signals A and B are the same in peak value (voltage value), for example, 20 V. The invention is related to a method for downsizing an ink droplet as shown in the copending application, attorney docket No. 101734, filed concurrently, entitled "Ink Droplet Ejecting Method and Apparatus", and incorporated herein by reference.

The wave width of the jet pulse signal A is assumed to be of a value coincident with the ratio of the above length L to the sonic velocity, a, in the ink present within the ink chamber 613, i.e., L/a (=T), or corresponds to an odd-multiple time, a value peculiar to a head, thereof. A time difference between a fall timing of the jet pulse signal A and a rise timing of the additional pulse signal B is set to be 0.55T. The wave width of the additional pulse signal B is set to be 0.35T. This wave width is not sufficient for the additional pulse signal B to eject an ink droplet. When only the jet pulse signal A is applied, the volume of ink droplet will be approximately 30 pl. On the other hand, when both the jet pulse and additional pulse is applied as shown in FIG. 1, the volume of ink droplet will be approximately 20 pl. The pulse cycle for printing the next dot in a continuous manner is 100 μsec, assuming that the driving frequency is 10 kHz. This driving waveform may result in ink ejection becoming unstable at a high temperature as will be described later.

Figure 2:
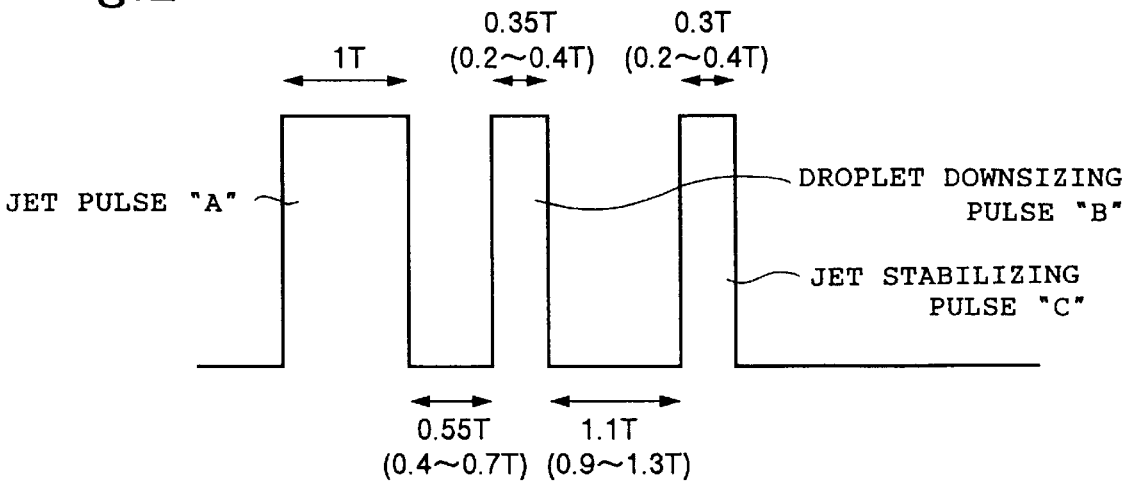
FIG. 2 is a diagram showing a driving waveform according to Example 1 in the invention.

FIG. 2 shows a driving waveform according to Example 1 in the invention. The driving waveform comprises the same jet pulse signal A and first additional pulse signal (hereinafter referred to as "droplet downsizing pulse") B as shown in FIG. 1, as well as a second additional pulse signal ("jet stabilizing pulse" hereinafter) C which is a non-jet pulse for stabilizing the ejection of ink. Jet stabilizing pulses have been discussed in Japanese Patent Application No. HEI 9-112745, the disclosure of which is incorporated by reference herein.

The jet pulse signal A has the same pulse width as jet pulse signal A shown in FIG. 1. The droplet downsizing pulse B and the jet stabilizing pulse C each have a pulse width of 0.2T to 0.4T, preferably 0.35 T in pulse B and 0.3T in pulse C, relative to the jet pulse signal A. A time difference between a fall timing of the jet pulse signal A and a rise timing of the droplet downsizing pulse B is 0.4T to 0.7T, preferably 0.55T, and a time difference between a fall timing of the droplet downsizing pulse B and a rise timing between jet stabilizing pulse C is 0.9T to 1.3T, preferably 1.1T. The effect obtained by the addition of the jet stabilizing pulse C will be explained later in a discussion of the driving waveform shown in FIG. 1. The above numerical values and ranges have been determined experimentally. The results of the experiment are shown in Table 1 below which presents the results obtained for various relationships of the delay (d2) from the end of the droplet downsizing pulse B to the start of the jet stabilizing pulse C and Wc is the duration of the jet stabilizing pulse C.

TABLE 1

| | d2 | | | | | | |
|---|---|---|---|---|---|---|---|
| Wc | 0.8 T | 0.9 T | 1.0 T | 1.1 T | 1.2 T | 1.3 T | 1.4 T |
| 0.15 T | X | X | X | X | X | X | X |
| 0.20 T | X | ○ | ○ | ○ | ○ | ○ | X |
| 0.25 T | X | ○ | ○ | ○ | ○ | ○ | X |
| 0.30 T | X | ○ | ○ | ○ | ○ | ○ | X |
| 0.35 T | X | ○ | ○ | ○ | ○ | ○ | X |
| 0.40 T | X | ○ | ○ | ○ | ○ | ○ | X |
| 0.45 T | X | X | X | X | X | X | X |

O: No deviation in trajectory/no scatter
X: spray/no discharge

Figure 3:
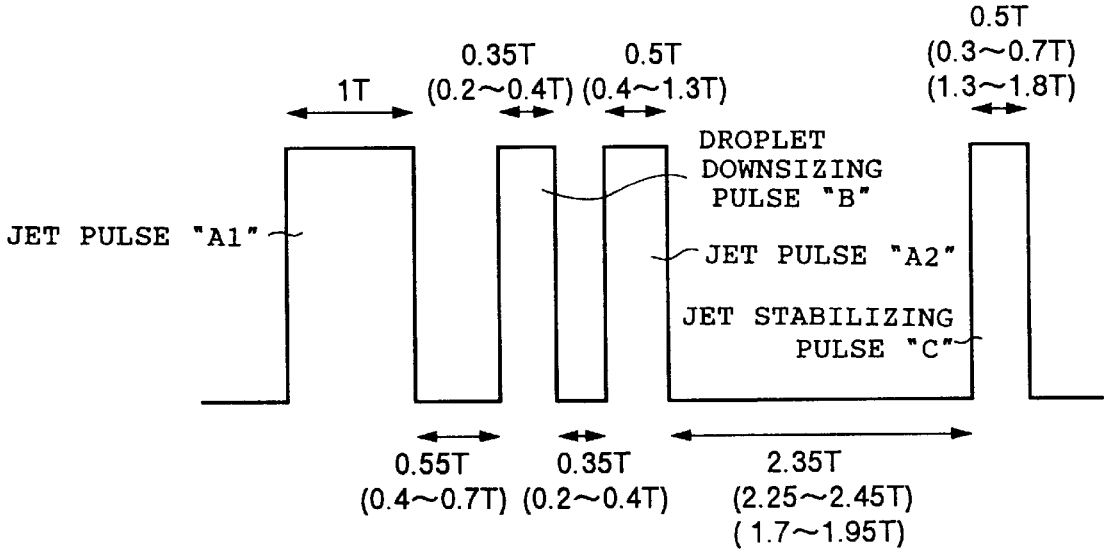
FIG. 3 is a diagram showing a driving waveform according to Example 2 in the invention.

FIG. 3 shows a driving waveform according to Example 2 in the invention. The driving waveform is different from the driving waveform shown in FIG. 2 in that the jet pulse signal A is divided into two jet pulses A1 and A2 and the droplet downsizing pulse B is positioned between the jet pulses A1 and A2. According to the driving waveform, in comparison with that shown in FIG. 2, since the jet pulse A is divided into two jet pulses, the droplet volume can be adjusted as desired and it becomes possible to enhance the gradation. The jet pulse A1 has a same pulse width as the jet pulse A in FIG. 1 and the jet pulse A2 has a pulse width of 0.4T to 1.3T, preferably 0.5T. A time difference between a fall timing of the jet pulse signal Al and a rise timing of the droplet downsizing pulse B is, like that in FIG. 2, 0.4T to 0.7T, preferably 0.55T. The pulse width of the droplet downsizing pulse B is 0.2T to 0.4T, preferably 0.35T. A time difference between a fall timing of the jet pulse signal A, jet pulse signal A2, and a rise timing of the jet stabilizing pulse C is 2.25T to 2.45T, or 1.7T to 1.95T, preferably 2.35T. The pulse width of the jet stabilizing pulse C is 0.3T to 0.7T, or 1.3T to 1.8T, preferably 0.5T. The droplet volume obtained by this driving waveform is 40 pl (picoliter).

Figure 4:
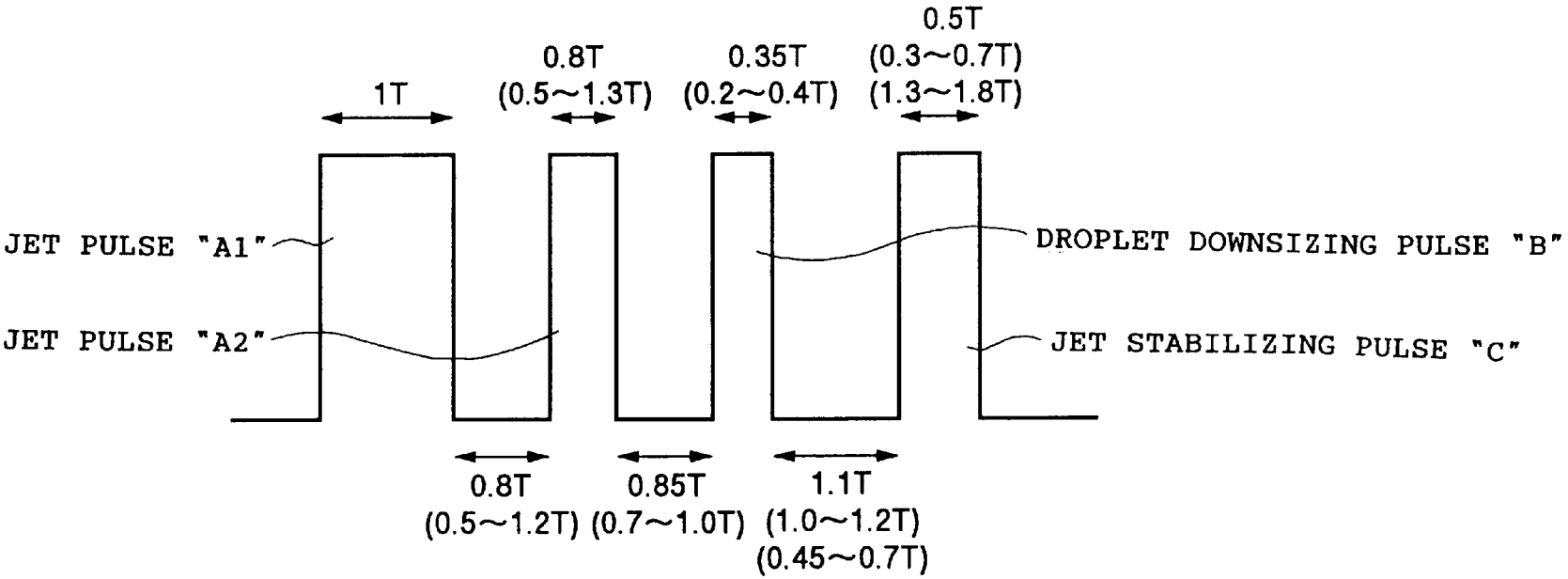
FIG. 4 is a diagram showing a driving waveform according to Example 3 in the invention.

FIG. 4 shows a driving waveform according to Example 3 of the invention. This driving waveform is different from the driving waveform shown in FIG. 3 in that the droplet downsizing pulse B and the jet stabilizing pulse C are positioned after the two jet pulses A1 and A2 of the jet pulse signal A. The same difference in function as in FIG. 3 is obtained in comparison with the driving waveform shown in FIG. 2. A time difference between a fall timing of the jet pulse signal A1 and a rise timing of the jet pulse signal A2 is 0.5T to 1.2T, preferably 0.8T. The pulse width of the jet pulse signal A2 is 0.5T to 1.3T, preferably 0.8T. A time difference between a fall timing of the jet pulse signal A2 and a rise timing of the droplet downsizing pulse B is 0.7T to 1.0T, preferably 0.85T. The pulse width of the droplet downsizing pulse B is 0.2T to 0.4T, preferably 0.35T. A time difference between a fall timing of the droplet downsizing pulse B and a rise timing of the jet stabilizing pulse C is 1.0T to 1.2T, or 0.45T to 0.7T, preferably 1.1T. The pulse width of the jet stabilizing pulse C is 0.3T to 0.7T, or 1.3T to 1.8T, preferably 0.5T. The droplet volume obtained by the driving waveform of example 3 is also 40 pl.

Figure 5:
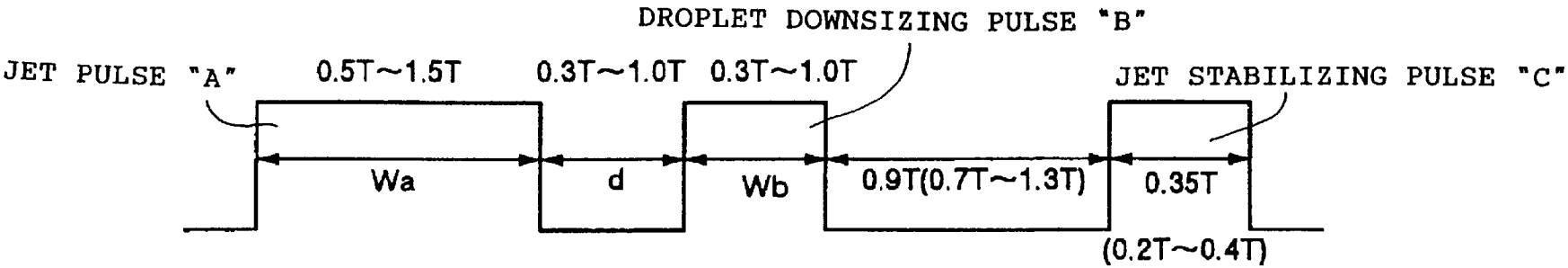
FIG. 5 is a diagram showing a driving waveform according to Example 4 in the invention.

FIG. 5 shows a driving waveform according to Example 4 of the invention. The driving waveform has substantially a same form as the waveform shown in FIG. 2. In case of the above example, the pulse width of a jet pulse signal is T or an odd-multiple time of T. In the driving waveform of the present example, the pulse width Wa of the jet pulse signal A is set to between 0.5T and 1.5T, and both a time difference d between a fall timing of the jet pulse signal A and a rise timing of the droplet downsizing pulse B and the pulse width Wb of the droplet downsizing pulse B are set to predetermined values in order to avoid the occurrence of spraying or an incomplete ejection when an ink droplet is ejected. Here, spraying means a phenomenon that ink does not form an ink droplet, rather the ink disperses. Table 2 shows the results of experimentation that the combination of time difference d and pulse width Wb is varied on the condition that the pulse width Wa of the jet pulse signal A is set to 0.5T through 1.5T. A "O" means ejection was acceptable, i.e., there was no incomplete ejection or spraying and an "X" means that spraying or an incomplete ejection occurred. According to the results, it is clear that no print error occurs if a time difference d between a fall timing of the jet pulse signal A and a rise timing of the droplet downsizing pulse B is 0.3T to 1.0T, and the pulse width Wb of the droplet downsizing pulse B is 0.3T to 1.0T, and the sum of time difference d and pulse width Wb is 0.7T to 1.3T. Further, a time difference d between a fall timing of the droplet downsizing pulse B and a rise timing of the jet stabilizing pulse C should be 0.7T to 1.3T or preferably 0.9T, and the pulse width of the jet stabilizing pulse C should be 0.2T to 0.4T, preferably 0.35T.

187 rises and the electric current flowing in the base of the transistor TR102 increases, providing conduction between the emitter and the collector of the transistor TR102. A voltage of 20(V) from the positive power source 187 is applied to the capacitor 191 and terminal 191A via the collector and emitter of the transistor TR102 and resistor R120.

Figure 8A:
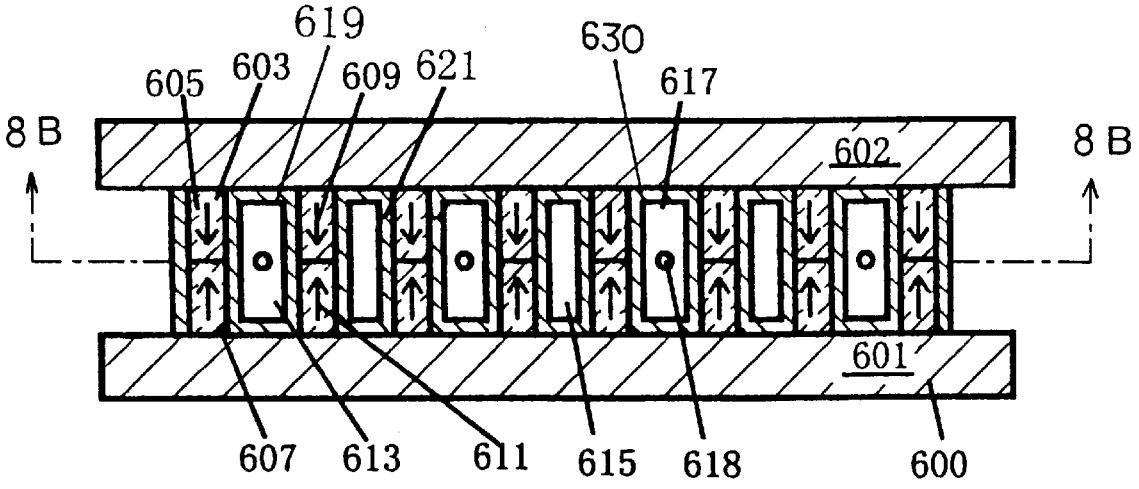
FIG. 8A is a longitudinal sectional view of an ink ejecting portion of a printing head.
Figure 8B:
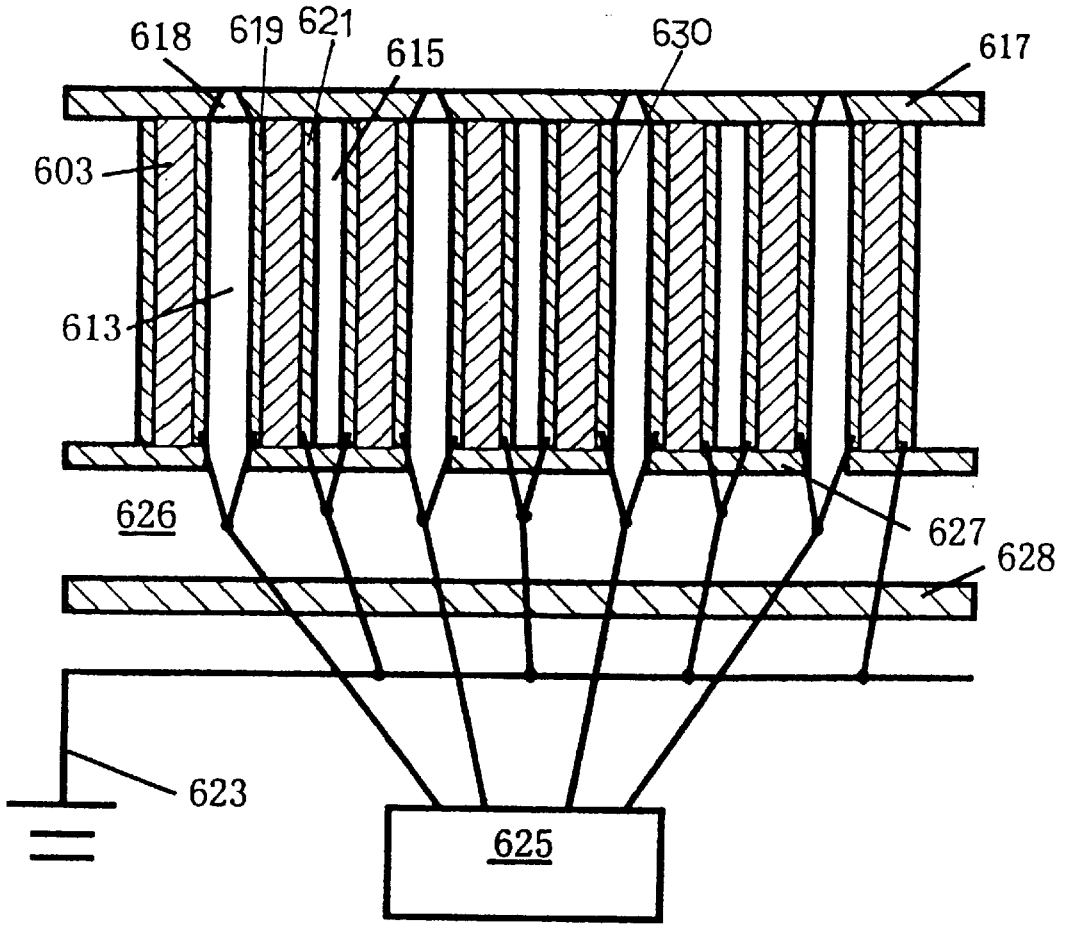
FIG. 8B is a transverse sectional view of an ink ejecting portion of a printing head viewed along 8B—8B of FIG. 8A.
Figure 9:
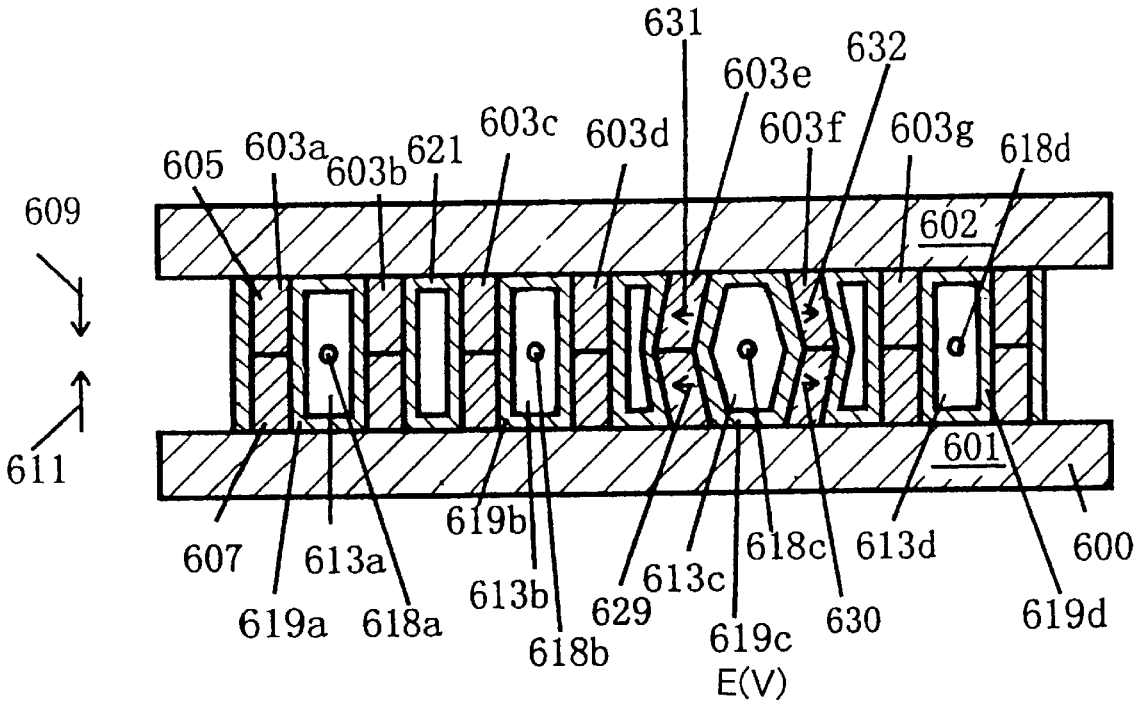
FIG. 9 is a longitudinal sectional view showing the operation of the ink ejecting portion of the printing head.

The discharge circuit 184 comprises resistors R106, R107 and a transistor TR103. When an ON signal (+5V) is applied to the input terminal 183, the transistor TR103 turns conductive via resistor R106 and the terminal 191A on the resistor R120 side of the capacitor 191 is grounded via resistor R120, so that the electric charge imposed on the actuator wall 603 of the ink chamber 613, shown in FIGS. 8A, 8B and 9, is discharged.

Figure 7:
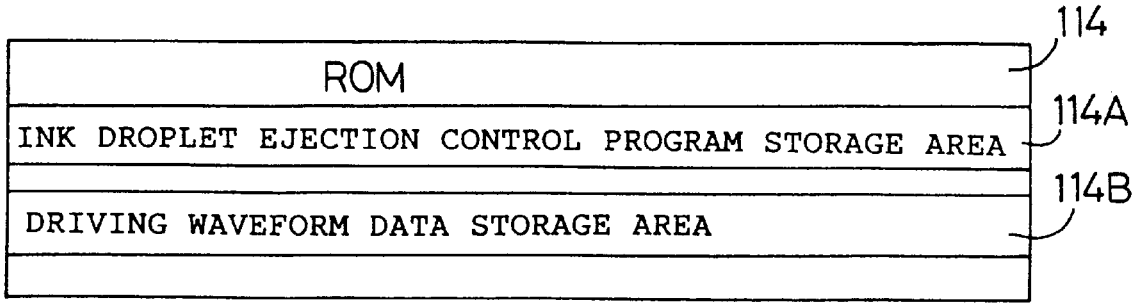
FIG. 7 is a diagram showing storage areas of a ROM in a controller of the ink droplet ejecting apparatus.

The pulse control circuit 186 generates pulse signals to be received by the input terminal 181 of the charging circuit 182 and the input terminal 183 of the discharge circuit 184. Provided in the pulse control circuit 186 is a CPU 110 which performs various arithmetic operations. Connected to the CPU 110 are a RAM 112 for the storage of printing data and various other data and a ROM 114 which stores sequence data for generating ON-OFF signals in accordance with a control program and timing in the pulse control circuit 186. In the ROM 114, as shown in FIG. 7, there are provided an area 114A for the storage of an ink droplet ejection control program and an area 114B for the storage of driving waveforms. Thus, sequence data of a driving waveform is stored in the driving waveform data storage area 114B.

TABLE 2

| | d | | | | | | | | | |
|---|---|---|---|---|---|---|---|---|---|---|
| Wb | 0.3T | 0.4T | 0.5T | 0.6T | 0.7T | 0.8T | 0.9T | 1.0T | 1.1T | 1.2T |
| 0.3T | X | ○ | ○ | ○ | ○ | ○ | ○ | ○ | X | X |
| 0.4T | ○ | ○ | ○ | ○ | ○ | ○ | ○ | X | X | X |
| 0.5T | ○ | ○ | ○ | ○ | ○ | ○ | X | X | X | X |
| 0.6T | ○ | ○ | ○ | ○ | ○ | X | X | X | X | X |
| 0.7T | ○ | ○ | ○ | ○ | X | X | X | X | X | X |
| 0.8T | ○ | ○ | ○ | X | X | X | X | X | X | X |
| 0.9T | ○ | ○ | X | X | X | X | X | X | X | X |
| 1.0T | ○ | X | X | X | X | X | X | X | X | X |
| 1.1T | X | X | X | X | X | X | X | X | X | X |
| 1.2T | X | X | X | X | X | X | X | X | X | X |

○: No deviation in trajectory/no scatter
X: spray/no discharge

Figure 6:
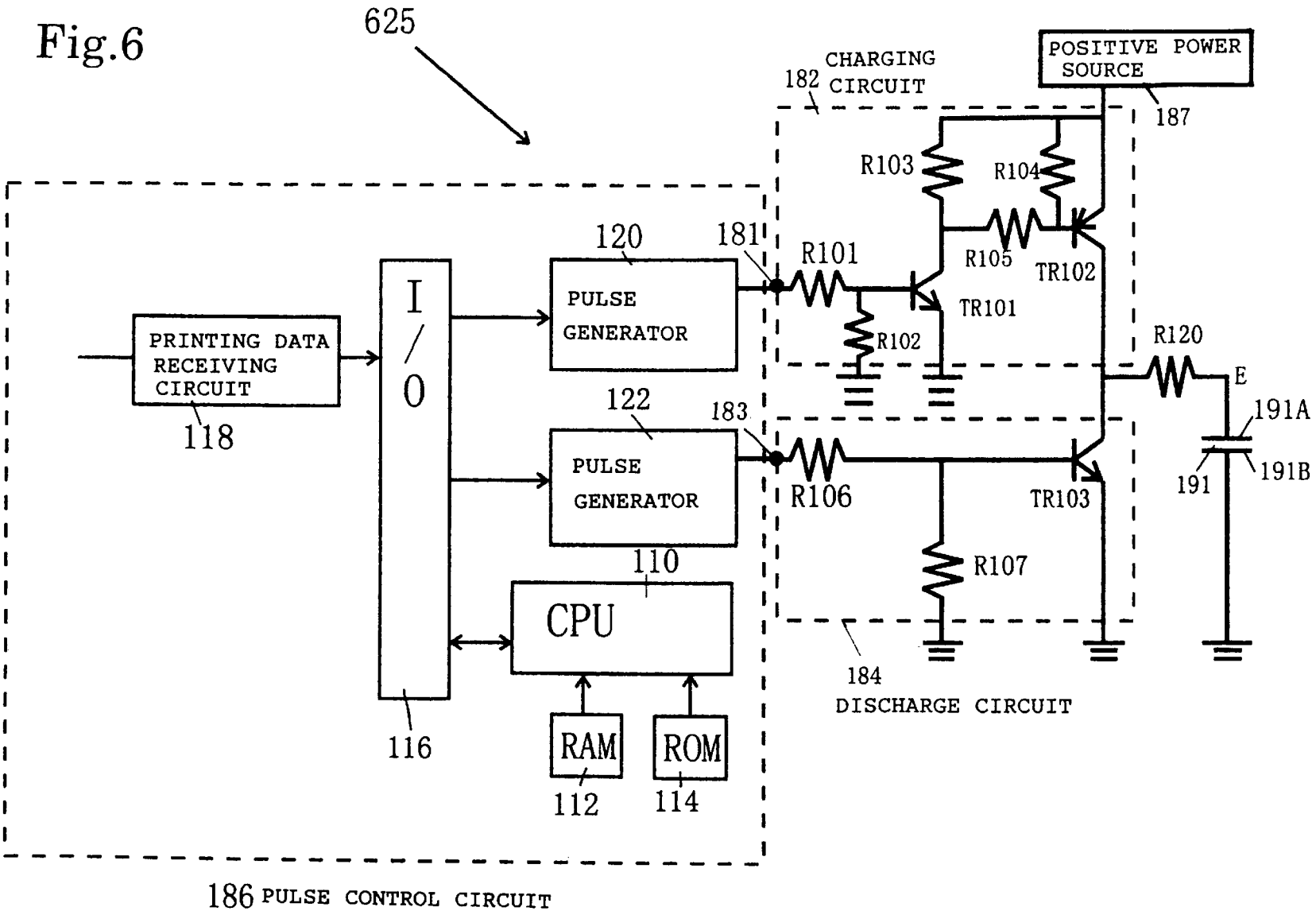
FIG. 6 is a diagram showing a drive circuit used in an ink droplet ejecting apparatus embodying the invention.

Next, an example of a controller for implementing the described driving waveforms, shown in FIGS. 2 to 5, will be described with reference to FIGS. 6 and 7. A controller 625, shown in FIG. 6, comprises a charging circuit 182, a discharge circuit 184 and a pulse control circuit 186. The piezoelectric material of the actuator wall 603 and electrodes 619, 621 are represented equivalently by a capacitor 191. Numerals 191A and 191B denote terminals of the capacitor 191.

Input terminals 181 and 183 are for inputting pulse signals to adjust the voltage to be applied to the electrode 619 in each ink chamber, to E(V) or O(V). The charging circuit 182 comprises resistors R101,R102,R103,R104,R105 and transistors TR101, TR102.

Figure 10:
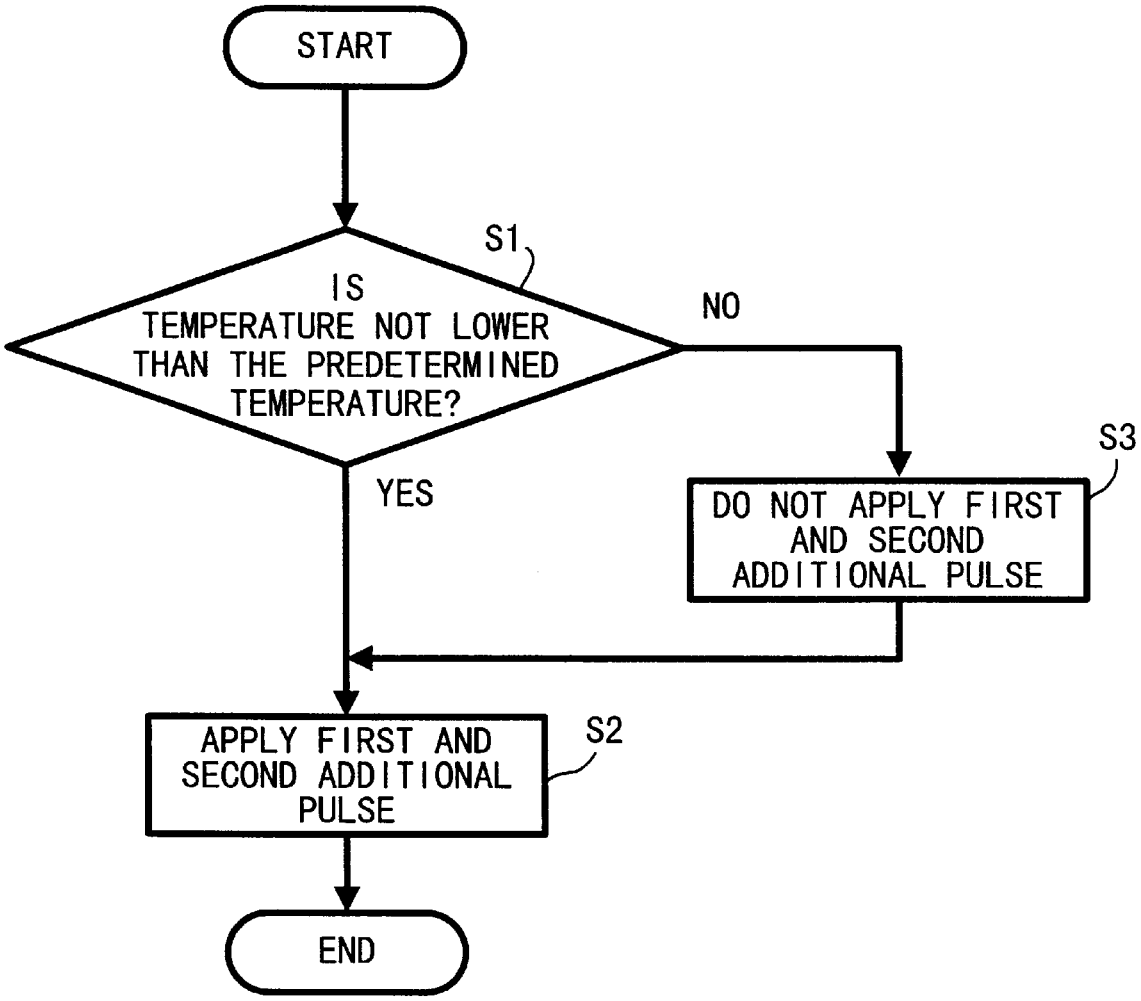
FIG. 10 is a flow chart explaining control contents of the ROM in the controller of the ink droplet ejecting apparatus.

When an ON signal (+5V) is applied to the input terminal 181, the transistor TR101 conducts through resistor R101, so that an electric current flows from a positive power source 187, passes through resistor R103, and flows from the collector to the emitter of transistor TR101. Consequently, a divided voltage of the voltage applied to the resistors R104 and R105 which are connected to the positive power source Though not shown, the controller 625 is provided with means for detecting temperatures related to ink, such as ambient temperature. In the control program storage area 114 there also is stored a program, as shown in FIG. 10, according to which the CPU 110 judges whether the temperature is not lower than a predetermined value (S1), then on the basis of the result of the judgment determines whether the first and second additional pulses B and C (droplet downsizing pulse and stabilizing pulse) are to be added to the jet pulse signal A (S2,S3).

The CPU 110 is further connected to an I/O bus 116 for transmission and reception of various data, and to the I/O bus 116 are connected a printing data receiving circuit 118 and pulse generators 120,122. The output of the pulse generator 120 is connected to the input terminal 181 of the charging circuit 182, while the output of the pulse generator 122 is connected to the input terminal 183 of the discharge circuit 184.

The CPU 110 controls the pulse generators 120,122 in accordance with the sequence data stored in the driving waveform data storing area 114B of the ROM 114.

Therefore, by having various patterns of the foregoing timing stored beforehand in the driving waveform data storing area 114B of the ROM 114, it is possible to apply a driving pulse of the driving waveform 10, shown in FIG. 2, to the actuator wall 603.

The pulse generators 120,122, the charging circuit 182 and the discharge circuit 184 are provided in the same number as the number of nozzles used. Although the above description was directed to controlling one nozzle, the same control is applied to the other nozzles as well.

Reference is now made to Tables 3 and 4 below, showing the results of ink droplet ejection tests (ink droplet speed: m/s) conducted under various temperature conditions respectively with use of pulses of the driving waveform shown in FIG. 2 and use of pulses of the driving waveform shown in FIG. 1. Table 3 was obtained using the time T shown as a specific time in FIG. 2. In each figure, the top numerals (1 to 10) represent dot numbers as driven at a predetermined frequency (16 kHz) and the numerals (5 to 40) in the leftmost column represent temperatures (° C.). The ejection of ink was performed in such a manner that five (No. 1 to No. 5) continuous dots were followed by a one-dot rest (No. 6), subsequent two continuous dots (Nos. 7 and 8), subsequent one-dot rest (No. 9) and subsequent one dot (No. 10). The pulses of the driving waveform shown in FIG. 2 or FIG. 1 are applied to each dot. The parenthesized numerical values adjacent to the temperatures are voltage values applied in 8 m/s ejection of ink droplets at the respective temperatures.

TABLE 3

| | Dots | | | | | | | | | |
|---|---|---|---|---|---|---|---|---|---|---|
| ° C.(V) | 1 | 2 | 3 | 4 | 5 | 6 | 7 | 8 | 9 | 10 |
| 5(19.0) | 8.0 | 8.7 | 9.0 | 9.1 | 9.1 | — | 8.0 | 8.5 | — | 8.0 |
| 10(18.6) | 8.0 | 8.9 | 9.1 | 9.2 | 9.2 | — | 8.1 | 8.8 | — | 8.2 |
| 15(17.9) | 8.0 | 8.8 | 9.1 | 9.1 | 9.1 | — | 8.1 | 8.7 | — | 8.2 |
| 20(17.0) | 8.0 | 8.7 | 9.2 | 9.2 | 9.2 | — | 8.2 | 8.6 | — | 8.3 |
| 25(16.0) | 8.0 | 8.6 | 9.1 | 9.1 | 9.1 | — | 8.2 | 8.3 | — | 8.3 |
| 30(15.2) | 8.0 | 8.6 | 9.1 | 9.1 | 9.1 | — | 8.6 | 8.3 | — | 8.6 |
| 35(14.3) | 8.0 | 8.4 | 9.1 | 9.1 | 9.1 | — | 8.7 | 8.0 | — | 8.7 |
| 40(13.7) | 8.0 | 8.3 | 9.0 | 9.0 | 9.0 | — | 8.7 | 7.6 | — | 8.5 |

TABLE 4

| | Dots | | | | | | | | | |
|---|---|---|---|---|---|---|---|---|---|---|
| ° C.(V) | 1 | 2 | 3 | 4 | 5 | 6 | 7 | 8 | 9 | 10 |
| 5(19.0) | 8.0 | 7.2 | 7.9 | 8.0 | 8.0 | — | 8.2 | 6.5 | — | 8.2 |
| 10(18.6) | 8.0 | 7.2 | 7.9 | 8.0 | 8.0 | — | 8.3 | 6.6 | — | 8.3 |
| 15(17.9) | 8.0 | 7.3 | 8.0 | 8.0 | 8.0 | — | 8.3 | 6.5 | — | 8.4 |
| 20(17.0) | 8.0 | 7.3 | 8.0 | 8.1 | 8.1 | — | 8.5 | 6.2 | — | 8.8 |
| 25(16.0) | 8.0 | 7.3 | 8.0 | 8.1 | 8.0 | — | 8.6 | 5.7 | — | 9.0 |
| 30(15.2) | 8.0 | 7.3 | 8.0 | 8.1 | 8.1 | — | 8.9 | 5.3 | — | 8.5 |
| 35(14.3) | 8.0 | 7.3 | 7.7 | 7.8 | 8.1 | — | 8.7 | 5.2 | — | 8.4 |
| 40(13.7) | 8.0 | 7.3 | 6.0 | 7.0 | X | — | 8.6 | 5.1 | — | 8.0 |

As is seen from Table 3, with an increase of temperature, the droplet speed of the second dot in the two continuous dots after a one-dot rest which follows continuous dots tends to decrease. Particularly, in the driving waveform of FIG. 1 with only the droplet downsizing pulse B annexed thereto, the decrease of speed is marked at the underlined portion in Table 4. This is presumed to be because in the underlined portion in Table 4, the high temperature region, the ink viscosity decreases and it becomes impossible to prevent meniscus oscillation. Particularly, if the droplet downsizing pulse B rises with ink meniscus retracted from the nozzle, the meniscus tries to withdraw to a further extent, so that the droplet ejecting speed further decreases. As a result, the ink droplet applied position is displaced and the print quality deteriorates. In contrast therewith, if the droplet stabilizing pulse C is added, as in the driving waveform of FIG. 2, the decrease in speed at the underlined portion is prevented and the problem discussed above is solved. In the tests, the results shown in Table 3, the droplet downsizing pulse B and the jet stabilizing pulse C are added to all the dots irrespective of temperature. In practical use, as shown in FIG. 10, it suffices for both additional pulses to be applied only when the temperature is not lower than a predetermined temperature (say 25° C.). The "X", in Table 4, stands for an unmeasured portion. In the low temperature region where the ink viscosity is relatively high, not only the load on the controller 625 is lightened but it also becomes possible to narrow the spacing of the jet pulse A and the effect the ejection of ink with a high cycle.

An explanation will now be given how the reduction in size of an ink droplet is made possible by the addition of the droplet downsizing pulse B to the jet pulse signal A, as shown in FIGS. 1 or 2. At the leading edge of the jet pulse signal A, the volume of the ink chamber increases and the ink meniscus withdraws inwards of the nozzle temporarily, then at a trailing edge of the jet pulse signal A, after the lapse of the time required for one-way propagation of a pressure wave through the ink chamber, the volume of the ink chamber decreases from the increased state to a normal state, whereby the ink is about to be ejected from the nozzle. At this time, the droplet downsizing pulse B is applied, so that a part of the ink droplet being ejected from the nozzle becomes a pulled-back meniscus and the size of the ink droplet ejected from the nozzle is reduced. In this way, without changing the driving voltage and, without an increase in cost, the ejection of an ink droplet having a small volume can be attained merely by the addition of a non-jet pulse after the main driving waveform.

Although an embodiment of the invention has been described above, the invention is not limited thereto. For example, although in the above embodiment both droplet downsizing pulse B and jet stabilizing pulse C were added to one jet pulse A as a main driving signal, if there are no dots before and after the dot concerned, there may be used only one jet pulse A as a main drive signal for that dot. Further, the structure of the ink droplet ejecting apparatus 600 is not limited to the one described in the above embodiment. There may be used a like apparatus opposite in polarizing direction of the piezoelectric material.

Although in the above embodiment the air chambers 615 are formed on both sides of each ink chamber 613, the ink chambers may be formed in a directly adjacent manner without forming the air chambers. Further, although the actuator used in the above embodiment is a shear mode type, there may be adopted a structure wherein layers of a piezoelectric material are laminated together and a pressure wave is generated by a deformation in the laminated direction. No limitation is placed on the piezoelectric material, but there may be used any other material insofar as a pressure wave is generated in each ink chamber.

What is claimed is:

1. An ink droplet ejecting method in which a jet pulse signal is applied to an actuator that changes the volume of an ink chamber filled with ink, to generate a pressure wave within the ink chamber, thereby applying pressure to the ink and allowing a droplet of the ink to be ejected from a nozzle, comprising the steps of:

applying the jet pulse signal in accordance with a one-dot printing instruction;

applying a first additional pulse signal for downsizing the ink droplet which is ejected in accordance with said jet pulse signal; and applying a second additional pulse signal for stabilizing the ejection of the ink.

2. The ink droplet ejecting method according to claim 1, wherein the jet pulse signal has a pulse width which allows the volume of the ink chamber to increase upon application of a voltage to the actuator, thereby causing a pressure wave to be generated within the ink chamber, and which, after the lapse of time T required for an approximately one-way propagation of the pressure wave through the ink chamber or after the lapse of an odd-multiple of the time T, allows the volume of the ink chamber to decrease from the increased state to a normal state, said first and second additional pulse signals have a pulse width of approximately 0.2T to 0.4T relative to the jet pulse signal, a time difference between a fall timing of the jet pulse signal and a rise timing of the first additional pulse signal is 0.4T to 0.7T, and a time difference between a fall timing of the first additional pulse signal and a rise timing of the second additional pulse signal is 0.9T to 1.3T.

3. The ink droplet ejecting method according to claim 2, wherein a peak value of the jet pulse signal and peak values of the first and second additional pulse signals are all the same.

4. The ink droplet ejecting method according to claim 2, wherein the jet pulse signal comprises two jet pulse signals.

5. An ink droplet ejecting method according to claim 2, wherein the jet pulse signal is divided into a primary jet pulse signal and a secondary jet pulse signal, and the first additional signal is applied between the primary jet pulse signal and the secondary jet pulse signal.

6. The ink droplet ejecting method according to claim 1, wherein a peak value of the jet pulse signal and peak values of the first and second additional pulse signals are all the same.

7. The ink droplet ejecting method according to claim 6, wherein the jet pulse signal comprises two jet pulse signals.

8. An ink droplet ejecting method according to claim 6, wherein the jet pulse signal is divided into a primary jet pulse signal and a secondary jet pulse signal, and the first additional signal is applied between the primary jet pulse signal and the secondary jet pulse signal.

9. The ink droplet ejecting method according to claim 1, wherein the jet pulse signal comprises two jet pulse signals.

10. The ink droplet ejecting method according to claim 9, wherein the jet pulse signal is divided into a primary jet pulse signal and a secondary jet pulse signal, and the first additional signal is applied between the primary jet pulse signal and the secondary jet pulse signal.

11. An ink droplet ejecting method according to claim 1, wherein the jet pulse signal is divided into a primary jet pulse signal and a secondary jet pulse signal, and the first additional signal is applied between the primary jet pulse signal and the secondary jet pulse signal.

12. The ink droplet ejecting method according to claim 1, wherein the jet pulse signal has a pulse width which allows the volume of the ink chamber to increase upon application of a voltage to the actuator, thereby causing a pressure wave to be generated within the ink chamber, and which, after the lapse of time T required for an approximately one-way propagation of the pressure wave through the ink chamber or after the lapse of approximately 0.5T to 1.5T;

the first additional pulse signal has a pulse width of approximately 0.3T to 1.0T and a time difference between a fall timing of the jet pulse signal and a rise timing of the first additional pulse signal has a time difference of 0.3T to 1.0T;

a sum of a time difference between a fall timing of the jet pulse signal and a rise timing of the first additional pulse signal and a pulse width of said first additional pulse signal is approximately 0.7T to 1.3T;

the second additional pulse signal has a pulse width of approximately 0.2T to 0.4T, and a time difference between a fall timing of said first additional pulse signal and a rise timing of the second additional pulse signal is approximately 0.7T to 1.3T.

13. An ink droplet ejecting apparatus, including:

an ink chamber filled with ink;

an actuator for changing the volume of the ink chamber;

a driving power source for applying an electric signal to the actuator; and a controller providing control so that a jet pulse signal is applied to the actuator from the driving power source to increase the volume of the ink chamber and thereby generate a pressure wave in the ink chamber and so that when the time required for an approximately one-way propagation of the pressure wave through the ink chamber is assumed to be T, the volume of the ink chamber is decreased from the increased state to a normal state after the lapse of the time T or after the lapse of an odd-multiple time of the time T, thereby applying pressure to the ink present in the ink chamber and allowing an ink droplet to be ejected, wherein the controller, in accordance with a one-dot printing instruction, causes the jet pulse signal to be applied to the actuator from the driving power source and causes a first additional pulse signal for downsizing the ink droplet which is ejected in accordance with the jet pulse signal and a second additional pulse signal for stabilizing the ejection of the ink, as non-jet pulse signals which follow the application of the jet pulse signal, to be applied from the driving power source.

14. The ink droplet ejecting apparatus according to claim 13, wherein peak values of the first and second additional pulse signals are the same as a peak value of the jet pulse signal, and the first additional pulse signal is smaller in pulse width than the jet pulse signal and is outputted so as to pull back a part of the ink droplet which is ejecting in accordance with the jet pulse signal.

15. The ink droplet ejecting apparatus according to claim 14, wherein said controller controls the jet pulse signal to have a pulse width which allows the volume of the ink chamber to increase upon application of a voltage to the actuator, thereby causing a pressure wave to be generated within the ink chamber and which, after the lapse of time T required for an approximately one-way propagation of the pressure wave through the ink chamber or after the lapse of an odd-multiple of the time T, allows the volume of the ink chamber to decrease from the increased state to a normal state, and so that the first and second additional pulse signals have a pulse width of approximately 0.2T to 0.4T relative to the jet pulse signal, a time difference between a fall timing of the jet pulse signal and a rise timing of the first additional pulse signal is 0.4T to 0.7T, and a time difference between a fall timing of the first additional pulse signal and a rise timing of the second additional pulse signal is 0.9T to 1.3T.

16. The ink droplet ejecting apparatus according to claim 13, wherein the controller has a temperature detecting means and controls the application of the first and second additional pulse signals in accordance with the temperature detected by the temperature detecting means.

17. The ink droplet ejecting apparatus according to claim 13, wherein the ink ejecting pulse signal has a pulse width approximately 0.5T to 1.5T;

the first additional pulse signal has a pulse width of approximately 0.3T to 1.0T and a time difference between a fall timing of the jet pulse signal and a rise timing of the first additional pulse signal has a time difference of 0.3T to 1.0T;

a sum of a time difference between a fall timing of the jet pulse signal and a rise timing of said first additional pulse signal and a pulse width of said first additional pulse signal is approximately 0.7T to 1.3T; and the second additional pulse signal has a pulse width of approximately 0.2T to 0.4T, and a time difference between a fall timing of said first additional pulse signal and a rise timing of said second additional pulse signal is approximately 0.7T to 1.3T.

18. A method for ejecting a reduced size ink droplet from a printhead of an ink jet printer, comprising the steps of:

applying an ejection pulse to an ink chamber to eject an ink droplet;

applying a second ejection pulse, subsequent to the ejection pulse, at a timing to cause withdrawal of a portion of the ink droplet into the ink chamber such that the reduced size ink droplet is ejected; and applying a jet stabilizing pulse subsequent to the ejection pulse and the second ejection pulse.

19. The method according to claim 18, wherein a pulse direction of the ejection pulse is a multiple of T in a range of 0.5T–1.5T, T being equal to a length of the ink chamber divided by a sonic velocity of ink in the ink chamber, a delay between the ejection pulse and the second ejection pulse is in the range 0.3T–1.0T, and the second ejection pulse is in the range 0.3T–1.0T.

20. The method according to claim 18, wherein a pulse direction of the ejection pulse is a multiple of T in a range of 0.5T–1.5T, T being equal to a length of the ink chamber divided by a sonic velocity of ink in the ink chamber, the jet stabilizing pulse is initiated in a range of 0.7–1.3T after the second ejection pulse and a duration of the jet stabilizing pulse is in a range of 0.2–0.4T.

21. The method according to claim 18, wherein the step of applying an ejection pulse comprises the steps of applying an initial ejection pulse and a reinforcing ejection pulse.

22. The method according to claim 21, wherein the second ejection pulse is applied between the initial ejection pulse and the reinforcement ejection pulse.

23. The method according to claim 18, further comprising steps of:

determining a temperature of ink in the ink chamber;

comparing the temperature of the ink to a predetermined temperature; and suppressing the application of the second ejection pulse and the ink stabilizing pulse when the temperature is greater than the predetermined temperature.

* * * * *